US006539729B2

(12) United States Patent
Tupis et al.

(10) Patent No.: US 6,539,729 B2
(45) Date of Patent: Apr. 1, 2003

(54) REFRIGERATOR AIRFLOW DISTRIBUTION SYSTEM AND METHOD

(75) Inventors: Jeffery Allen Tupis, Louisville, KY (US); Martin Christopher Severance, Louisville, KY (US); Arthur Wilson Scrivener, Louisville, KY (US); Gerald Eugene Sturgeon, Louisville, KY (US); Richard DeVos, Goshen, KY (US); Steven Gray, Prospect, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/754,540

(22) Filed: Jan. 5, 2001

(65) Prior Publication Data

US 2002/0116943 A1 Aug. 29, 2002

(51) Int. Cl.[7] ..... F25D 17/08
(52) U.S. Cl. ..... 62/89; 62/264; 62/414
(58) Field of Search ..... 62/408, 414, 419, 62/426, 89, 264

(56) References Cited

U.S. PATENT DOCUMENTS 3,070,973 A * 1/1963 O'Connell ..... 62/180
3,405,281 A * 10/1968 Wilson ..... 307/38
3,572,049 A 3/1971 Moorman ..... 62/132
3,702,544 A * 11/1972 Grinups ..... 62/414
3,793,847 A 2/1974 Scarlett et al. ..... 62/190
3,992,171 A 11/1976 Jenewein ..... 62/419
4,671,078 A * 6/1987 Pink ..... 62/408
4,920,765 A * 5/1990 McCauley et al. ..... 62/408
5,778,694 A * 7/1998 Jeong ..... 62/187
5,870,900 A 2/1999 Mohebbi et al. ..... 62/187
5,901,562 A 5/1999 Tunzi et al. ..... 62/229
5,970,736 A * 10/1999 Gong et al. ..... 62/408
6,055,820 A 5/2000 Jeong et al.
6,401,482 B1 * 6/2002 Lee et al. ..... 62/408

* cited by examiner

*Primary Examiner*—William E. Tapolcai
(74) *Attorney, Agent, or Firm*—Armstrong Teasdale LLP

(57) ABSTRACT

A refrigerator includes a vertically extending airflow distribution assembly for reducing vertical temperature gradients therein, and laterally extending air passages are in flow communication with the air distribution assembly for reducing horizontal temperature gradients therein. A single fan simultaneously directs freezer compartment air into the air distribution assembly, the laterally extending passages and into a storage drawer for temperature regulation therein. A damper is located in flow communication with a light assembly and is selectively positionable to cool the refrigeration compartment through the air distribution assembly and the laterally extending passages, as well as to remove heat from the light assembly that may damage a refrigeration compartment liner.

20 Claims, 6 Drawing Sheets

REFRIGERATOR AIRFLOW DISTRIBUTION SYSTEM AND METHOD

BACKGROUND OF THE INVENTION

This invention relates generally to refrigerators, and more specifically, to an apparatus for reducing temperature gradients in refrigerator fresh food compartments.

Known refrigerators typically regulate a temperature of a fresh food compartment by opening and closing a damper established in flow communication with a freezer compartment, and by operating a fan to draw cold freezer compartment air into the fresh food compartment as needed to maintain a desired temperature in the fresh food compartment.

In known refrigerators, however, achieving uniform temperatures in the fresh food compartment is challenging. For a variety of reasons, items placed in upper regions of the fresh food compartment tend to be undercooled, and items placed in lower regions of the fresh food compartment tend to be overcooled. In addition, items placed nearer to a back wall of the fresh food compartment may be chilled more than items placed farther away from the back wall. These vertical and horizontal temperature gradients in fresh food compartments are undesirable. While efforts have been made to control and improve airflow distribution in refrigerator fresh food compartments, see, for example U.S. Pat. No. 6,055,820, lower cost and simpler airflow distribution systems are desired.

In addition, known refrigerators typically include lamps to illuminate refrigeration compartments. Typically, the lamps are illuminated in response to switches or sensors that energize the lamp when the respective refrigerator door is opened. When the door is open for an extended period of time, however, heat generated in the lamp can rise to levels that may damage the refrigeration compartment liner. If the liner is damaged, refrigerator performance and reliability is compromised.

BRIEF SUMMARY OF THE INVENTION

In an exemplary embodiment, a refrigerator includes a freezer compartment and a fresh food compartment including a first side and a second side opposite the first side. An airflow distribution assembly is located in the fresh food compartment in flow communication with the freezer compartment, and extends vertically along the first side of the fresh food compartment for distributing freezer compartment air into the fresh food compartment. Lateral air passages also extend from the first side of the fresh food compartment to the second side of the fresh food compartment and are in flow communication with the air distribution assembly. The air distribution assembly reduces vertical temperature gradients by regulating airflow into the first side of the fresh food compartment, such as the back wall of the compartment, and the lateral air passages introduce freezer compartment air into the opposite side of the fresh food compartment, such as the front side, and therefore reduce horizontal temperature gradients in the fresh food compartment.

The air distribution assembly and the laterally extending passages are in flow communication with a single fan that simultaneously directs freezer compartment air into the air distribution assembly and also into the laterally extending passages. Still further, air is delivered from the air distribution assembly to a storage drawer for temperature regulation therein. Thus, freezer compartment air is distributed to front and rear sides of the fresh food compartment, as well as to a storage drawer, with a single fan.

A damper is located in flow communication with a light assembly in the fresh food compartment. The damper is selectively positionable between a closed position allowing the fan to cool the fresh food compartment, and an open position that creates a pressure drop in the light assembly and causes air to flow through the light assembly and remove heat that may damage a refrigeration compartment liner when the light assembly is energized for an extended time.

A single damper and a single fan are therefore employed to regulate temperature in a refrigerator fresh food compartment, reduce temperature gradients in the compartment, supply freezer compartment air to a storage drawer, and remove heat generated in a light assembly that could damage the refrigerator liner.

DETAILED DESCRIPTION OF THE INVENTION

Figure 1:
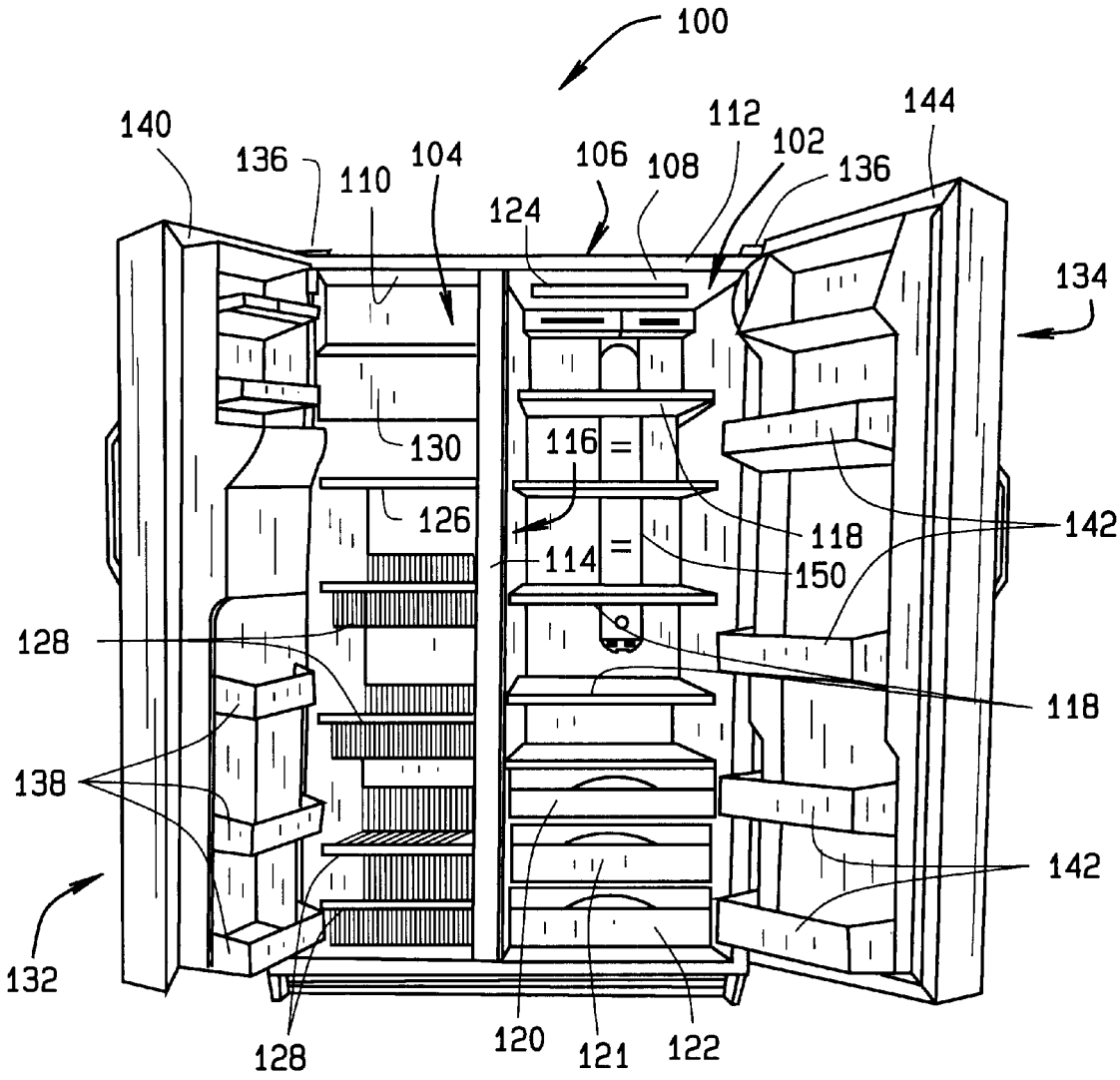
FIG. 1 is a perspective view of a refrigerator including an airflow distribution assembly.

FIG. 1 illustrates an exemplary side-by-side refrigerator 100 in which the invention may be practiced. It is contemplated, however, that the teaching of the description set forth below is applicable to other types of refrigeration appliances, including but not limited to top and bottom mount refrigerators wherein undesirable temperature gradients exist. The present invention is therefore not intended to be limited to be limited to any particular type or configuration of a refrigerator, such as refrigerator 100.

Refrigerator 100 includes a fresh food storage compartment 102 and freezer storage compartment 104, an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case 106. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 106, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances.

In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-syrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. It will be understood that in a refrigerator with separate mullion dividing an unitary liner into a freezer and a fresh food compartment, a front face member of mullion corresponds to mullion 114. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120, 121 normally are provided in fresh food compartment 102 to support items being stored therein. A bottom drawer or pan 122 partly forms a quick chill and thaw system (not shown in FIG. 1) selectively controlled, together with other refrigerator features, by a microprocessor (not shown) according to user preference via manipulation of a control interface 124 mounted in an upper region of fresh food storage compartment 102 and coupled to the microprocessor. Shelves 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

For improved airflow and reduced temperature gradients within fresh food compartment 102, an airflow distribution assembly 150 extends along a rear wall of fresh food compartment 102. As explained below, airflow distribution assembly 150 provides metered distribution of cold air from freezer compartment 104. In addition, airflow distribution assembly 150 supplies cold air to slide-out drawer 120 for temperature regulation of meat and/or vegetables stored therein.

Figure 2:
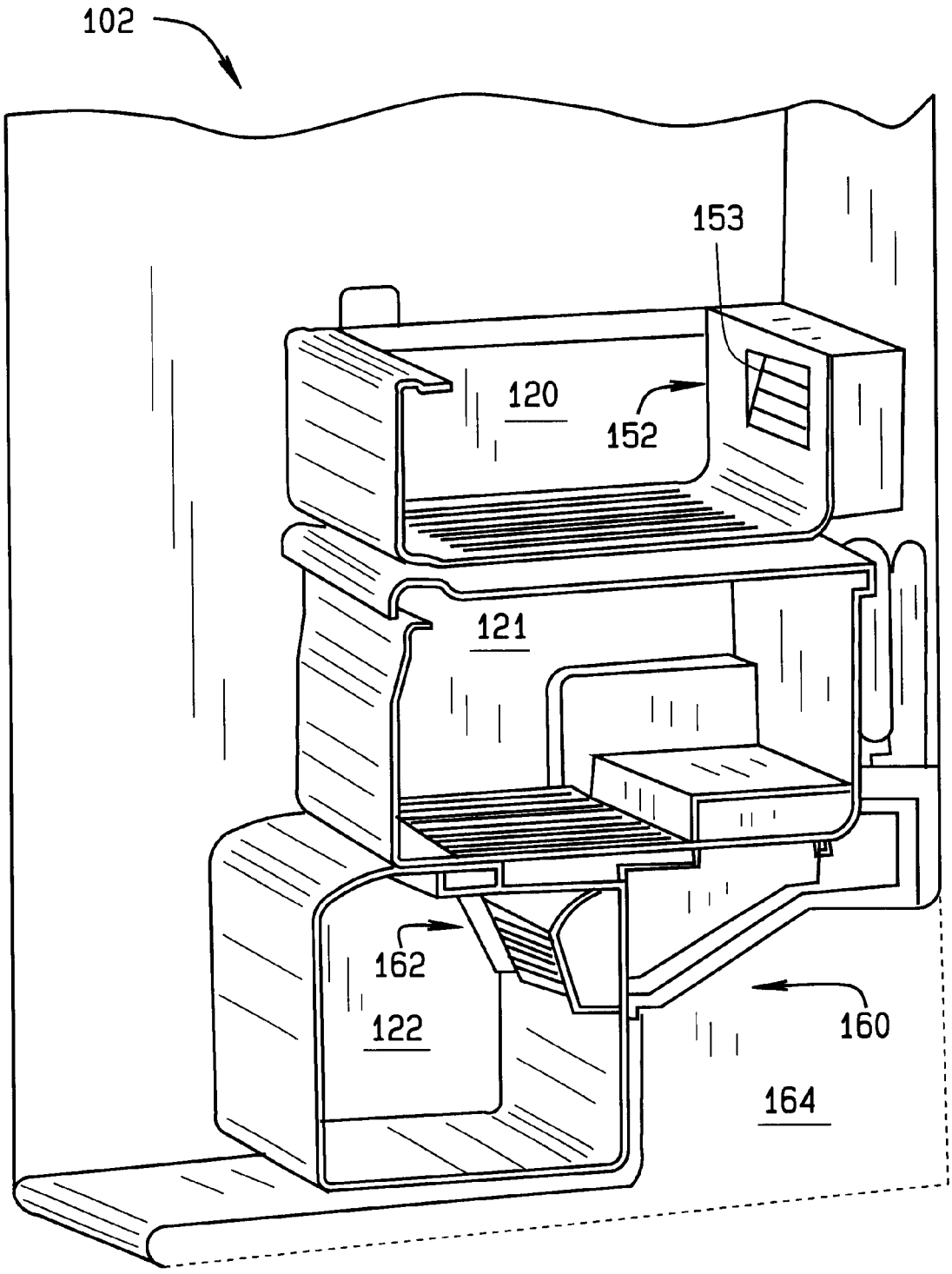
FIG. 2 is a partial perspective cut away view of a portion of the refrigerator shown in FIG. 1.

FIG. 2 is a partial cutaway view of fresh food compartment 102 illustrating storage drawers 120, 121 stacked upon one another and positioned, in one embodiment, above a quick chill and thaw system 160. Quick chill and thaw system 160 includes an air handler 162 and pan 122 located adjacent a pentagonal-shaped machinery compartment 164 (shown in phantom in FIG. 2) to minimize fresh food compartment space utilized by quick chill and thaw system 160. Storage drawers 120 includes a rear wall 152 having a cutout portion 153 therein for receiving regulated airflow from airflow distribution assembly 150 (shown in FIG. 1). Slide-out drawer 121 is a conventional slide-out drawer without internal temperature control, and a temperature of storage drawer 121 is therefore substantially equal to an operating temperature of fresh food compartment 102. In an alternative embodiment, drawer 121 also receives cold air from airflow distribution assembly 150.

Quick chill and thaw pan 122 is positioned slightly forward of storage drawers 120 to accommodate machinery compartment 164, and an air handler 162 selectively controls a temperature of air in pan 122 and circulates air within pan 122 to increase heat transfer to and from pan contents for timely thawing and rapid chilling, respectively. When quick thaw and chill system 160 is inactivated, pan 122 reaches a steady state at a temperature equal to the temperature of fresh food compartment 102, and pan 122 functions as a third storage drawer. In alternative embodiments, greater or fewer numbers of storage drawers 120, 121 and quick chill and thaw systems 160, and other relative sizes of quick chill pans 122 and storage drawers 120, 121 are employed.

It is recognized that the present invention operates independently of quick chill and thaw system 160 and quick chill and thaw pan 122. Therefore, refrigerator 100 is for illustrative purposes only, and the invention is in no way intended to be limited to refrigerators including quick chill and thaw systems.

In accordance with known refrigerators, machinery compartment 164 at least partially contains components for executing a vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize.

The vapor cycle components are controlled by a microprocessor and deliver cooled air to freezer compartment 104 (shown in FIG. 1). Temperature regulation of fresh food compartment 102 (shown in FIG. 1) is obtained by opening or closing a damper in flow communication with an opening through center mullion wall 116 (shown in FIG. 1) and drawing air into fresh food compartment 102 with a fan (not shown). Airflow distribution assembly 150 (shown in FIG. 1) provides even distribution of freezer compartment air throughout fresh food compartment 102 and into slide out drawer 120 for meat and vegetable temperature regulation.

Figure 3:
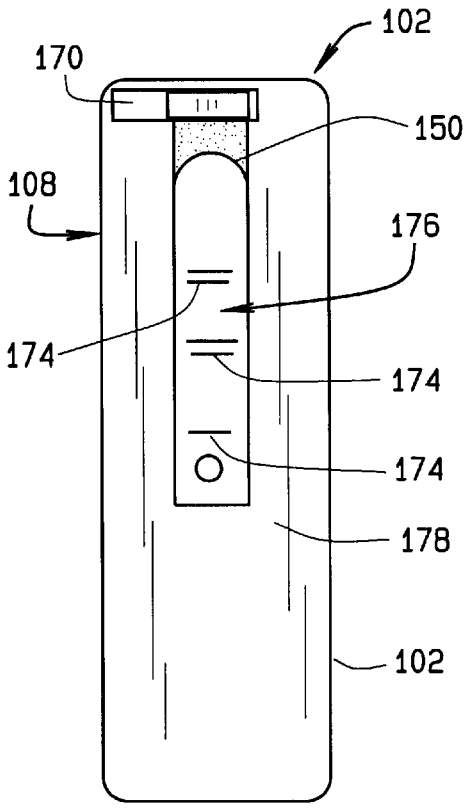
FIG. 3 is a front elevational view of a portion of the refrigerator shown in FIG. 1.

FIG. 3 is a front elevational view of fresh food compartment 102 and including air distribution assembly 150 attached to a rear wall of liner 108. Air distribution assembly 150 is in flow communication with freezer compartment 104 (shown in FIG. 1) through a duct 170 and a damper (not shown) in flow communication with an opening through center mullion wall 116 (shown in FIG. 1). Duct 170 is located at the top of fresh food compartment 102, and a fan (not shown) is used to draw freezer compartment air through the damper and duct 170 and downwardly into fresh food compartment 102 through vents 174 in a cover 176 of air distribution assembly 150. Cover 176 extends substantially from a top of fresh food compartment 102 to a mid-section of fresh food compartment 102 and is substantially centered between side walls of fresh food liner 108. A lower end of air distribution assembly includes a discharge 178 having vents for supplying freezer compartment air to storage drawer 120 (shown in FIGS. 1 and 2) and regulate temperature therein.

In alternative embodiments, other relative positions of duct 170 and air distribution assembly 150 are employed with respect to one another and with respect to fresh food compartment 102. For example, in one alternative embodiment, air distribution assembly 150 is attached to a side wall of fresh food liner 108. In a further alternative embodiment, duct 170 is located elsewhere than at the top of fresh food compartment 102 and air distribution assembly is used to direct air upwardly and/or downwardly from duct 170 to fresh food compartment 102. In still another alternative embodiment, air distribution assembly 150 is off-centered on one of the vertical walls of liner 108.

Figure 4:
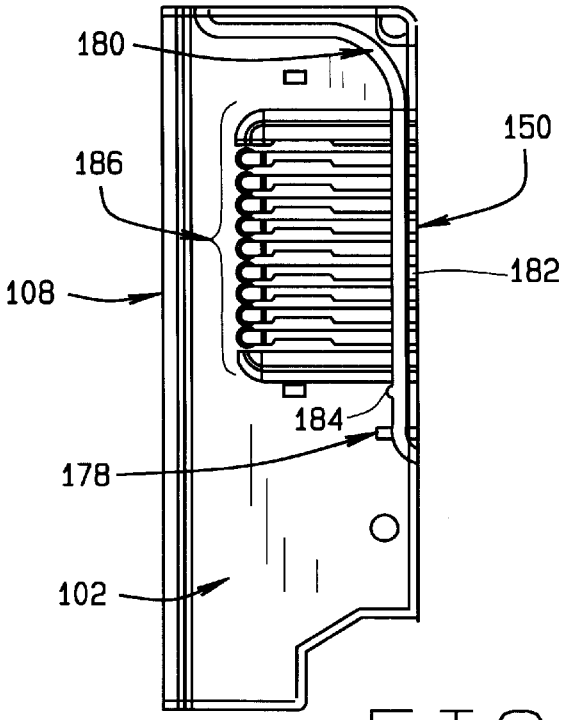
FIG. 4 is a sectional view of the portion of the refrigerator shown in FIG. 3.

FIG. 4 is a sectional view of fresh food compartment 102 illustrating air distribution assembly extending along a top and rear wall of liner 108. Air distribution assembly includes a hood portion 180 extending along the top of fresh food compartment 102, discharge 178 positioned for engagement with cutout portion of storage drawer 120 (see FIG. 2), and a vent portion 182 extending between hood portion 180 and discharge 178. In one embodiment, a manually adjustable knob 184 is located proximally to discharge 178 for user adjustment of airflow through discharge 178 into storage drawer 120. In an alternative embodiment, electronic controls are employed to select, deselect, and adjust airflow into storage drawer 120.

Air distribution assembly 150, as illustrated in FIG. 4, is compact in size to minimize impact on useable space in fresh food compartment 102, while providing regulated airflow into lower portions of fresh food compartment 102 to reduce temperature gradients therein. Vents 174 (shown in FIG. 3) are strategically positioned at selected vertical elevations to optimize airflow conditions in fresh food compartment 102 over a range of shelf positions 186 with respect to liner 108.

Figure 5:
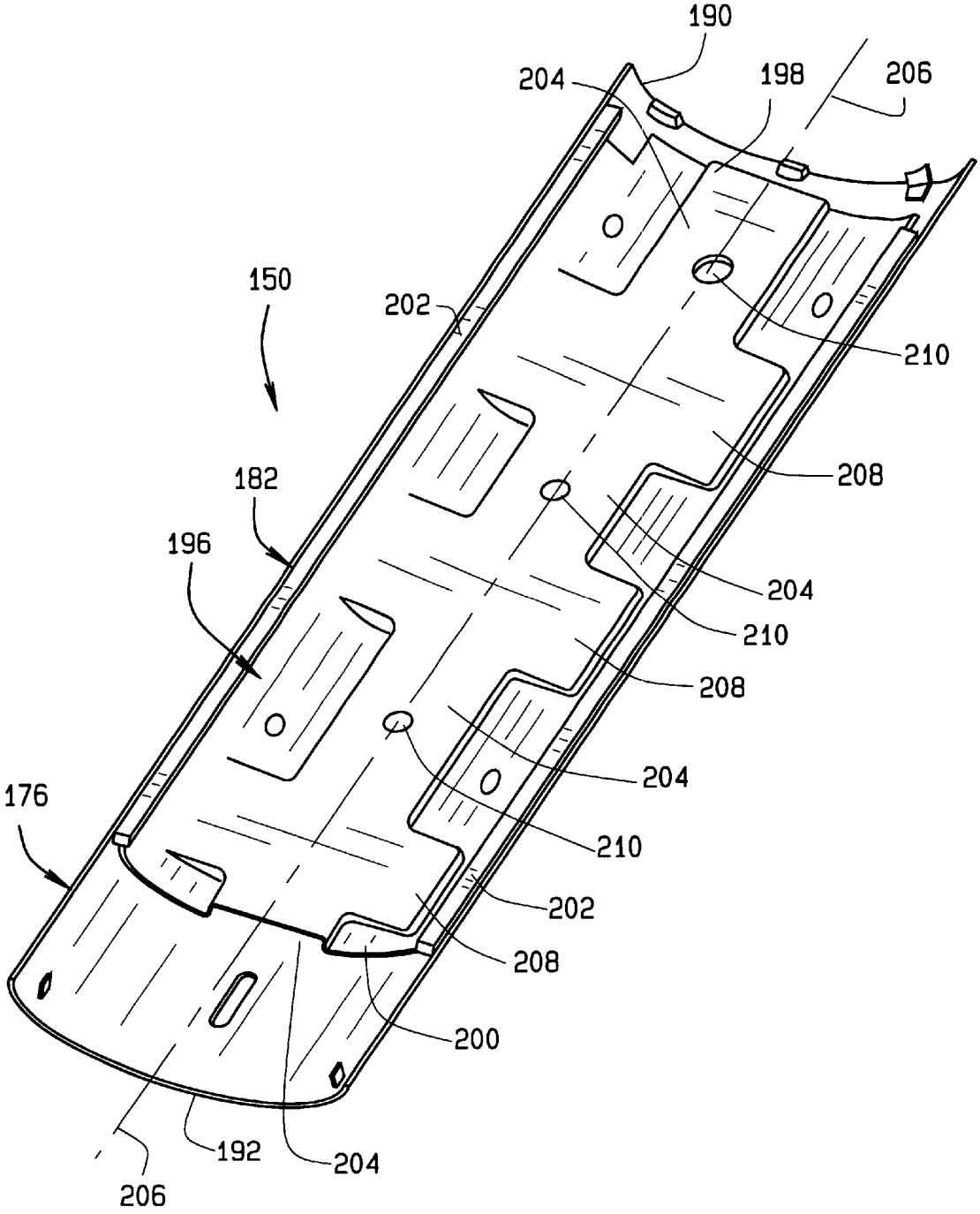
FIG. 5 is a perspective view of the airflow distribution assembly shown in FIGS. 1–4.

FIG. 5 is a perspective view of vent portion 182 of airflow distribution assembly 150 (shown in FIGS. 1, 3 and 4). Vent portion 182 includes cover 176 including an inlet end 190 and an outlet end 192, and a diverter 196 including an inlet end 198 and an outlet end 200 corresponding to ends 190, 192 of cover 176. Diverter 196 is coupled to cover 176, and a gasket 202 extends between diverter 196 and cover 176 to form an airtight seal between cover 176 and diverter 196. Diverter 196 is slightly recessed in rounded cover 176, and when vent portion 182 is attached to fresh food compartment liner 108 (shown in FIGS. 1–4), gaskets 202 seal vent portion 182 from fresh food compartment 102 and prevent mixing of fresh food compartment air with freezer compartment air inside of vent portion 182. When attached to liner 108, diverter 196 extends between liner 108 and cover 176. Inlet ends 190, 198 are placed in flow communication with hood portion 180 (shown in FIG. 4) and outlet ends 192, 200 are placed in flow communication with discharge 178 (shown in FIGS. 3 and 4).

Diverter 196 is closed at inlet end 198 so that freezer compartment air is forced into a primary flow path between diverter 196 and liner 108. A secondary flow path is created between diverter 196 and cover 176. Secondary flow path includes a longitudinal portion extending parallel to a longitudinal axis 206 of vent portion 182, and a plurality of lateral portions 208 extending generally transverse to longitudinal portion 204. In an exemplary embodiment, diverter 196 is fabricated from expanded polystyrene (EPS), and secondary flow path is integrally formed into diverter 196. In alternative embodiments, diverter 196 is fabricated from other known materials and in further embodiments is of a multi-piece construction.

The secondary flow path of diverter 196 is enclosed by cover 176. Cover vents 174 (shown in FIGS. 1 and 3) are positioned adjacent lateral portions 208 of secondary path so that freezer compartment air is distributed radially from curved cover 176 at a full width of lateral portions 208 of the secondary flow path. In an exemplary embodiment, cover 176 is fabricated from a known plastic material and contains a separately fabricated diverter 196. It is contemplated, however, that in alternative embodiments, cover 176 and diverter 196 may be fabricated from the same material, and may even be integrally formed in, for example, a known molding operation.

Diverter 196 includes a plurality of diverter openings 210 positioned between inlet end 198 and outlet end 200 and establishing flow communication between the primary flow path and the secondary flow path. A size of openings 210 decreases from inlet end 198 to outlet end 200, and each opening 210 is positioned within longitudinal portion 204 of the secondary flow path, i.e., away from lateral portions 208 of the secondary flow path. Therefore, as freezer compartment air travels from inlet end 198 to outlet end 200, a portion of the air in the primary airflow path is diverted through each successive diverter opening 210 and into longitudinal portions 204 of the secondary flow path. Once in the secondary flow path, air flows downwardly to lateral portions 208 of the secondary flow path and a portion of the air in lateral portions 208 flows through vents 174 in cover 176 and into fresh food compartment 102.

As diverter openings 210 are larger near inlet end 198, more air is diverted from the primary flow path in upper regions of vent portion 182 than in lower regions of vent portion 182, thereby metering air distribution to select locations in a manner to balance temperature gradients in fresh food compartment 102. With properly dimensioned diverter openings 210, secondary flow path portions, and cover vents 174 located at strategic vertical locations in fresh food compartment 102, a substantially uniform temperature gradient in fresh food compartment 102 is realized. It is appreciated that appropriate dimensions will vary for particular refrigerator capacities, platforms and configurations.

Cover outlet end 192 extends beyond diverter outlet end 200 so that the primary and secondary flow paths converge as air is moved toward storage drawer discharge 178 (shown in FIGS. 3 and 4).

A cost effective airflow distribution assembly is therefore provided that achieves desirable air temperature balance in a refrigerator fresh food compartment with minimal impact on usable fresh food compartment space and while providing freezer compartment air for temperature regulation of a fresh food drawer.

Figure 6:
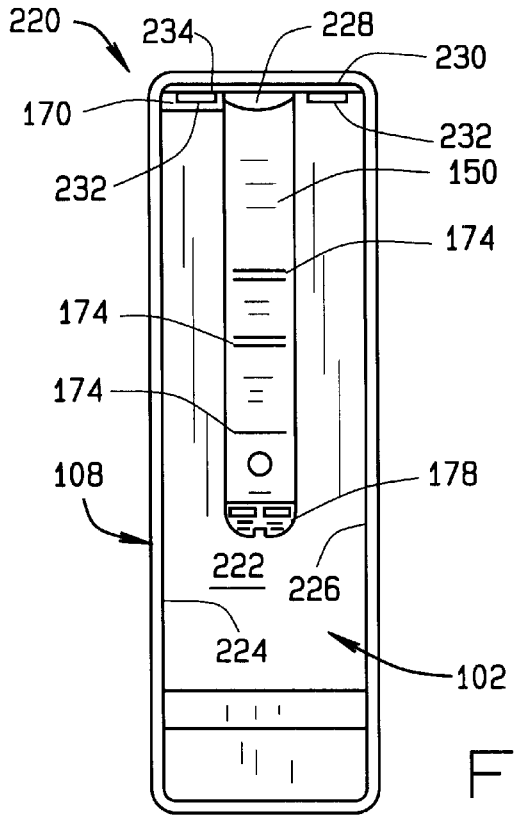
FIG. 6 is a front elevational view of a portion of a second embodiment of a refrigerator.
Figure 7:
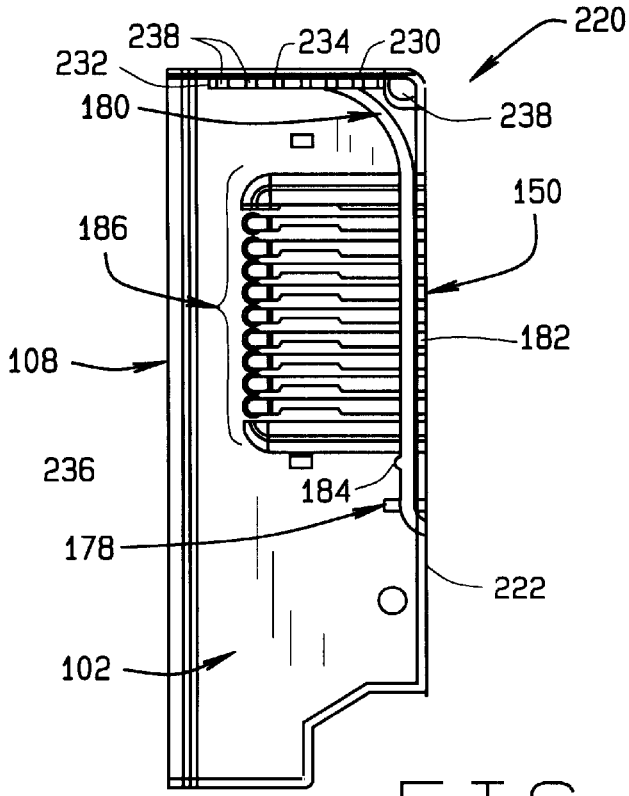
FIG. 7 is a sectional view of the portion of the refrigerator shown in FIG. 6.
Figure 8:
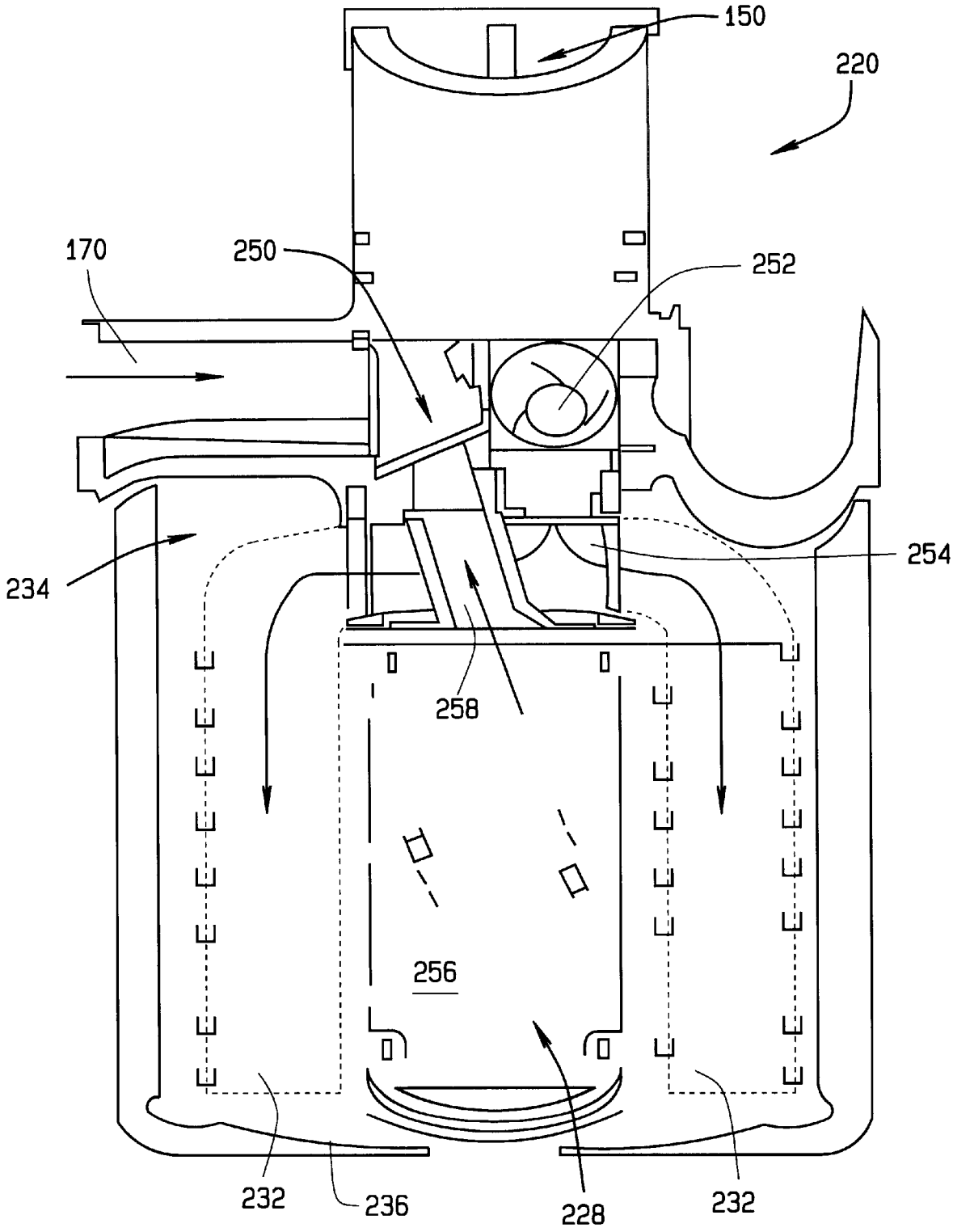
FIG. 8 is a functional schematic view of a portion of the refrigerator shown in FIGS. 6 and 7.

FIGS. 6–8 illustrate exemplary portions of a second embodiment of a refrigerator 220 in which common elements with refrigerator 100 (shown in FIGS. 1–5) are designated with like reference characters.

FIG. 6 is a front elevational view of fresh food compartment 102 of refrigerator 220, including air distribution assembly 150 extending vertically along a rear wall 222 of fresh food compartment 102 and substantially centered between opposite fresh food compartment side walls 224, 226. A light assembly 228 is substantially centered with respect to a top 230 of fresh food compartment 102 for illuminating fresh food compartment 102 when fresh food compartment door 134 is opened. A known door switch or sensor is coupled to a refrigerator controller microprocessor (not shown) to energize light assembly 228 according to known methods when a door opening is detected.

Air passages 232 extend laterally on either side of light assembly 228 from rear wall 222 toward a front of fresh food compartment 102 and are supported by a bezel 234 at fresh food compartment top 230. Air passages 232 are in flow communication with air distribution assembly so that freezer compartment air may be drawn through duct 170 with a single fan (not shown in FIG. 6) and simultaneously into passages 232 and air distribution assembly 150, and further to storage drawer 120 (shown in FIGS. 1 and 2) through air distribution assembly discharge 178. As explained above, air distribution assembly 150 reduces vertical temperature gradients by providing metered amounts of freezer compartment air through vents 174. Laterally extending passages 232 reduce horizontal temperature gradients in fresh food compartment by introducing cold freezer air at a front of fresh food compartment. Thus, freezer compartment air is received in both the front and rear of fresh food compartment 102 through passages 232 and air distribution assembly 150, respectively.

In an alternative embodiment, air distribution assembly 150 extends vertically along one of side walls 224, 226, and passages 232 extend to the opposite side wall, therefore providing balanced airflow between sides 224 and 226 of fresh food compartment 102.

FIG. 7 is a sectional view of fresh food compartment 102 of refrigerator 220 illustrating air distribution assembly extending vertically along fresh food compartment rear wall 222 and air passages 232 extending laterally along fresh food compartment top 230 between rear wall 122 and a front 236 of fresh food compartment 102. A fan (not shown in FIG. 7) is located in an upper rear corner 238 of fresh food compartment and is situated and angle, i.e., neither vertically nor horizontally, to direct air into both laterally extending passages 232 to deliver freezer compartment air to fresh food compartment front 236 and also downwardly into air distribution assembly 150 for producing regulated airflow at fresh food compartment rear wall 222.

In one embodiment, passages 232 extend substantially horizontally along fresh food compartment top 230. In an alternative embodiment, passages extend obliquely to fresh food compartment top 230 at a same or different angle than the fan to further adjust airflow through lateral passages 232.

Bezel 234 is attached to, supported by, or otherwise affixed to fresh food compartment top 230 and includes a plurality of downwardly depending support members 238 that receive laterally extending air passages 232. While in the illustrated embodiment air passages 232 are generally rectangular ducts, it is appreciated that differently shaped ducts may be used in alternative embodiments to deliver freezer compartment air to fresh food compartment front 236. Also, in an alternative embodiment, air passages 232 extend between bezel 234 and liner 108, and may be integrally formed into one or both of bezel 234 and liner 108.

FIG. 8 is a functional schematic view of an upper portion of fresh food compartment 102 of refrigerator 220 (shown in FIGS. 6 and 7). Duct 170 is in flow communication with freezer compartment air through an opening in center mullion wall 116 (shown in FIG. 1). A known damper mechanism 250 is located in flow communication with duct 170 and is controlled by a controller microprocessor (not shown). Damper mechanism 250 includes a damper door that is selectively positionable between a first position wherein airflow through duct 170 is substantially unimpeded and a second position wherein airflow through duct 170 is substantially blocked. A fan 252 is located in flow communication with damper 250 and is situated at an angle within duct 170. Thus, when damper 250 is in the first position and fan 252 is energized, freezer compartment air is drawn through duct 170 and is blown into air distribution assembly 150 extending downwardly along fresh food compartment rear wall 222 (shown in FIGS. 6 and 7), and also into a flow separator 254 that diverts airflow from fan 252 around light assembly 228 and into laterally extending passages 232 (shown in phantom in FIG. 8) that extend below bezel 234.

In an exemplary embodiment, flow separator 254 is fabricated from expanded polystyrene (EPS), and directs airflow from fan 252 from directly flowing into light assembly 238 through ventilation openings (not shown) in a light shield 256 that is snap-mounted to bezel 234. Light shield 256 is fabricated from a translucent material to evenly distribute light from a lamp (not shown) located within light shield 256 when the lamp is energized. Flow separator 254 prevents fan 252 from blowing freezer compartment air directly into light shield 256 which may undesirably create moisture in light assembly 238 from cold freezer compartment air impinging upon much warmer surfaces of light assembly components. Rather, flow separator 254 directs freezer compartment air to laterally extending passages 232 adjacent light assembly 238 and discharges air near fresh food compartment front 236. The relatively cold and dense air from passages 232 then falls in fresh food compartment 102 beneath passages 232 and away from light assembly 238.

A flow path bridge 258 extends across flow separator 254 and places light assembly 238 in flow communication with damper 250. In normal cooling operation, damper 250 is in the first position, a flow path through duct 170 is opened, and the flow path through bridge 258 is closed by the damper door. When fan 252 is energized, freezer compartment air is drawn through duct 170 and into air distribution assembly 150 and flow separator 254, and direct airflow into light assembly 238 is avoided. However, when damper 250 is in the second position, airflow through duct 170 is blocked, the flow path through bridge 258 is opened, and a pressure drop is created in light assembly 238. The pressure drop causes air to flow through the ventilation openings in light shield 256, thereby removing heat from light assembly In an exemplary embodiment, damper 250 is controlled to switch to the second position to prevent heat generated in light assembly 238 when the lamp is energized from damaging fresh food compartment liner 108 (shown in FIGS. 6 and 7). Thus, a liner protection mode is facilitated to remove heat from light assembly when the lamp is energized for an extended period of time, such as those typically encountered on appliance showroom floors and occasionally during actual use of refrigerator 220.

For example, in one embodiment, damper 250 is switched from the first position to the second position when the lamp has been energized for a predetermined time period, such as three minutes. When damper 250 is switched to the second position, freezer compartment air is blocked from fan 252, and fresh food compartment air is circulated through light assembly through flow path bridge 258 and through flow separator 254 and passages 232 to fresh food compartment front 236. Fresh food compartment airflow through light assembly 238 removes heat from light assembly 238 to prevent damage to liner 108, while minimizing moisture accumulation in light assembly by circulating fresh food compartment air in light assembly 238, as opposed to much colder freezer compartment air. Damper 250 remains in the second position and circulates fresh food compartment air through light assembly 238 until the lamp is de-energized, such as when fresh food door 134 is closed and an associated door switch or sensor is activated to break an electrical circuit through the lamp.

In an alternative embodiment, damper 254 is kept in the second position for a predetermined time to remove heat from light assembly 238, and then is switched back to the first position. In yet another alternative embodiment, actual temperature sensing is employed with known thermistors to sense a temperature of liner 108 adjacent light assembly 238, and damper 250 is switched between the first and second positions in response to a signal from the thermistor, thereby switching damper 250 position as needed to maintain desired temperature conditions of liner 108 adjacent light assembly 238.

In a further alternative embodiment, damper is positionable at an intermediate position in between the first position and the second position such that a combination of freezer compartment air and fresh food compartment air is circulated by fan 252. In a still further embodiment, an angle of fan 252 is adjustable to direct more or less air into air distribution assembly 150 and flow separator 254, and further to vary a pressure drop in light assembly when damper 250 opens flow path bridge 258 and causes airflow through light assembly 256. In addition, a variable speed fan could be employed to increase or decrease airflow through duct 170 and into fresh food compartment 102.

Therefore, by positioning and repositioning damper 250 and by energizing fan 252, temperature in a refrigerator fresh food compartment is regulated, temperature gradients in the compartment are reduced, freezer compartment air is supplied to a storage drawer, and heat is removed from a light assembly that could damage refrigerator liner 108. Performance and reliability of the refrigerator is therefore improved with a single fan, a single damper, and relatively simple and low cost components.

While the invention has been described in terms of various specific embodiments, those skilled in the art will recognize that the invention can be practiced with modification within the spirit and scope of the claims.

What is claimed is:

1. A refrigerator comprising:

a freezer compartment;

a fresh food compartment comprising a first side and a second side opposite said first side;

an airflow distribution assembly located in said fresh food compartment and in flow communication with said freezer compartment, said airflow distribution assembly extending vertically along said first side and comprising a plurality of vents for distributing freezer compartment air into said fresh food compartment; and at least one air passage in flow communication with said air distribution assembly, said air passage extending laterally from said first side to said second side.

2. A refrigerator in accordance with claim 1 further comprising a fan in flow communication with said air passage and in flow communication with said air distribution assembly.

3. A refrigerator in accordance with claim 1 further comprising a light assembly, said at least one passage located adjacent said light assembly.

4. A refrigerator in accordance with claim 3 further comprising a damper in flow communication with said light assembly.

5. A refrigerator in accordance with claim 1 further comprising a bezel, said bezel supporting said at least one air passage.

6. A refrigerator in accordance with claim 1, said air distribution assembly comprising a cover and a diverter within said cover for regulating flow through said vents.

7. A refrigerator in accordance with claim 6, said diverter configured to direct airflow between a primary flow path and a secondary flow path, said secondary flow path extending between said cover and said diverter.

8. A refrigerator in accordance with claim 1, said refrigerator further comprising a storage drawer, said air distribution assembly further comprising a discharge for delivering air into said storage drawer.

9. A refrigerator comprising:

a freezer compartment;

a fresh food compartment comprising a first side and a second side opposite said first side;

an airflow distribution assembly located in said fresh food compartment and in flow communication with said freezer compartment, said airflow distribution assembly extending vertically along said first side and comprising a plurality of vents;

at least one air passage in flow communication with said air distribution assembly, said air passage extending laterally from said first side to said second side; and a fan in flow communication with said airflow distribution assembly and in flow communication with said at least one passage, said fan configured to direct air concurrently through said airflow distribution assembly and said at least one passage.

10. A refrigerator in accordance with claim 9, said refrigerator further comprising a storage drawer, said air distribution assembly further comprising a discharge for delivering air into said storage drawer.

11. A refrigerator in accordance with claim 9 further comprising a light assembly, said at least one passage located adjacent said light assembly.

12. A refrigerator in accordance with claim 11 further comprising a damper in flow communication with said light assembly and in flow communication with said fan, said damper positionable to selectively create a pressure drop in said light assembly when said fan is energized.

13. A refrigerator in accordance with claim 11, said at least one passage comprising a first passage and a second passage, said refrigerator further comprising a flow separator, said flow separator configured to direct air from said fan away from said light assembly and into said first passage and said second passage.

14. A refrigerator in accordance with claim 9 further comprising a bezel, said bezel supporting said at least one air passage.

15. A refrigerator in accordance with claim 9, said air distribution assembly comprising a cover and a diverter within said cover for regulating flow through said vents.

16. A refrigerator in accordance with claim 15, said diverter configured to direct airflow between a primary flow path and a secondary flow path, said secondary flow path extending between said cover and said diverter.

17. A method for controlling airflow distribution in a refrigerator, the refrigerator including a freezer compartment and a fresh food compartment having a light assembly therein, a duct establishing flow communication between the freezer compartment and the fresh food compartment, a fan for drawing air through the duct, a damper in flow communication the fan and in flow communication with the light assembly, a flow separator in flow communication the fan for directing air away from the light assembly, and a fresh food compartment door, said method comprising the steps of:

positioning the damper to block airflow through the light assembly in a normal cooling operation;

operating the fan to draw freezer compartment air into the duct and into the flow separator;

energizing the light assembly when the fresh food compartment door is opened; and re-positioning the damper to place the light assembly in flow communication with the fan, thereby creating a pressure drop in the light assembly and causing airflow through the light assembly to remove heat from the light assembly.

18. A method in accordance with claim 17, said step of re-positioning the damper comprising the step of re-positioning the damper after the fresh food compartment door is opened for a predetermined time period.

19. A method in accordance with claim 17, the refrigerator further including a vertically extending air distribution assembly in the fresh food compartment, said step of operating the fan comprising the step of simultaneously directing air into the flow separator and into the air distribution assembly.

20. A method in accordance with claim 17 further comprising the steps of:

de-energizing the light assembly when the fresh food compartment door is closed; and returning the damper to block airflow through the light assembly after the light assembly is de-energized.

* * * * *

UNITED STATES PATENT AND TRADEMARK OFFICE

CERTIFICATE OF CORRECTION

PATENT NO. : 6,539,729 B2
DATED : April 1, 2003
INVENTOR(S) : Tupis et al.

It is certified that error appears in the above-identified patent and that said Letters Patent is hereby corrected as shown below:

Column 10,
Line 60, delete "communication the fan" and insert therefor -- communication with the fan --.
Line 62, delete "communication the fan" and insert therefor -- communication with the fan --.

Signed and Sealed this

Twenty-second Day of July, 2003

JAMES E. ROGAN
*Director of the United States Patent and Trademark Office*